US009644389B2

(12) United States Patent
Xie

(10) Patent No.: US 9,644,389 B2
(45) Date of Patent: May 9, 2017

(54) TENT APPARATUS

(71) Applicant: Jianqiang Xie, Linhai (CN)

(72) Inventor: Jianqiang Xie, Linhai (CN)

(73) Assignee: Yotrio Group Co., Ltd., Linhai, Zhejiang (CN)

( * ) Notice: Subject to any disclaimer, the term of this patent is extended or adjusted under 35 U.S.C. 154(b) by 0 days.

(21) Appl. No.: 14/805,705

(22) Filed: Jul. 22, 2015

(65) Prior Publication Data

US 2017/0022731 A1 Jan. 26, 2017

(51) Int. Cl.
*E04H 15/34* (2006.01)
*E04H 15/60* (2006.01)

(52) U.S. Cl.
CPC ..... *E04H 15/34* (2013.01); *E04H 15/60* (2013.01)

(58) Field of Classification Search
CPC A01G 9/22; A01G 9/242; E04B 7/166; E04F 10/02; E04H 15/34; E04H 15/58; E04H 15/42
USPC ..... 135/115, 903; 52/63, 66; 47/22.1
See application file for complete search history.

(56) References Cited

U.S. PATENT DOCUMENTS 2,118,474 A * 5/1938 Morton ..... E04H 15/003 135/115
3,100,950 A * 8/1963 Heuer ..... A01G 13/0206 135/115
3,140,563 A * 7/1964 Allen ..... A01G 13/0206 135/120.2
3,481,073 A * 12/1969 Eiichi ..... A01G 9/22 135/120.2
4,062,146 A * 12/1977 Grossman ..... A01G 9/22 135/90
5,265,373 A * 11/1993 Vollebregt ..... A01G 9/22 160/84.01
5,809,701 A * 9/1998 Vollebregt ..... A01G 9/1476 160/84.06
6,006,809 A * 12/1999 Williams ..... E04F 10/02 160/46
6,832,448 B2 * 12/2004 Stefan ..... A01G 9/242 160/84.06
9,038,648 B1 * 5/2015 Xie ..... E04H 15/60 135/114

(Continued)

FOREIGN PATENT DOCUMENTS

EP 1914361 A1 * 4/2008 ..... E04F 10/02

*Primary Examiner* — Noah Chandler Hawk
(74) *Attorney, Agent, or Firm* — Jingming (James) Cai; SAC Attorneys LLP

(57) ABSTRACT

A tent apparatus includes foot pipes, at least two beam members, girders, pulleys, cloth tubes, and a canopy. A first beam member and a second beam member are fastened perpendicular to a first pair of foot pipes and a second pair of foot pipes opposing each other respectively. The girders including internal guide rails are fastened perpendicular to the beam members. The pulleys traverse the internal guide rails of the girders. Each pulley includes a handle and wheel members in rolling communication with an internal guide rail, and a receptor member to receive and connect a cloth tube. The canopy is positioned over the cloth tubes. The canopy, attached to one of the beam members and in sliding communication with the girders, is stretched across the upper ends of the two pairs of foot pipes when the pulleys are rolled within the internal guide rails of the girders.

7 Claims, 6 Drawing Sheets

(56) References Cited

U.S. PATENT DOCUMENTS

| | | | | |
|---|---|---|---|---|
| 9,255,441 | B2 * | 2/2016 | Shargani | E04H 15/58 |
| 9,470,012 | B2 * | 10/2016 | Shargani | E04F 10/02 |
| 2004/0074157 | A1 * | 4/2004 | Chazal | E04B 1/3416 52/66 |
| 2017/0016245 | A1 * | 1/2017 | Bailey | E04F 10/02 |

* cited by examiner

TENT APPARATUS

BACKGROUND

A tent not only provides shelter but also provides a means for leisure and amusement. Conventional tents are typically opened and closed using cloth tubes, guide rails, and pulleys having a zinc die wheel frame with iron pieces, and bearings. This group of components comprising the zinc die wheel frame with iron pieces and bearings is complicated in structure, complicated in technical requirement, difficult to assemble and operate, and have high production costs. Moreover, during operation, conventional tents tend to break due to the fragile nature of the zinc die wheel frame, or the iron pieces become rusty. Therefore, in a conventional tent, if the pulling operation is not balanced, the pulling of a canopy of the tent will be difficult or obstructed, thereby making the conventional tent difficult to assemble.

Hence, there is a long felt but unresolved need for a tent apparatus that enhances the operation of opening and closing a canopy.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The tent apparatus disclosed herein addresses the above stated needs for enhancing the operation of opening and closing a canopy. The tent apparatus disclosed herein comprises foot pipes, at least two beam members, girders, pulleys, cloth tubes, and a canopy. A first pair of foot pipes is opposably positioned with respect to a second pair of foot pipes in a geometric configuration, for example, a rectangular configuration, a square configuration, etc. A first beam member is positioned perpendicular to the first pair of foot pipes and removably fastened to upper ends of the first pair of foot pipes. A second beam member is positioned perpendicular to the second pair of foot pipes and removably fastened to the upper ends of the second pair of foot pipes. The girders are positioned perpendicular to the beam members and removably fastened at predefined intervals to the beam members. The girders comprise internal guide rails for allowing the pulleys to rollably traverse the internal guide rails.

Each of the pulleys of the tent apparatus disclosed herein comprises a handle and wheel members. The wheel members of the pulleys are in rolling communication with the internal guide rails of the girders. Each pulley further comprises a receptor member for receiving and connecting one of the cloth tubes. The cloth tubes are positioned perpendicular to the girders and in sliding communication with the girders via the pulleys. Each cloth tube positions the canopy in an accordion configuration. The canopy is fixedly attached to one of the beam members and in sliding communication with the girders. The canopy is stretched across the upper ends of the first pair of foot pipes and the second pair of foot pipes when the pulleys are rolled within the internal guide rails of the girders.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing carries over to the description of that method step or structure shown by that same numeral in any subsequent drawing herein.

DETAILED DESCRIPTION OF THE INVENTION

Figure 1:
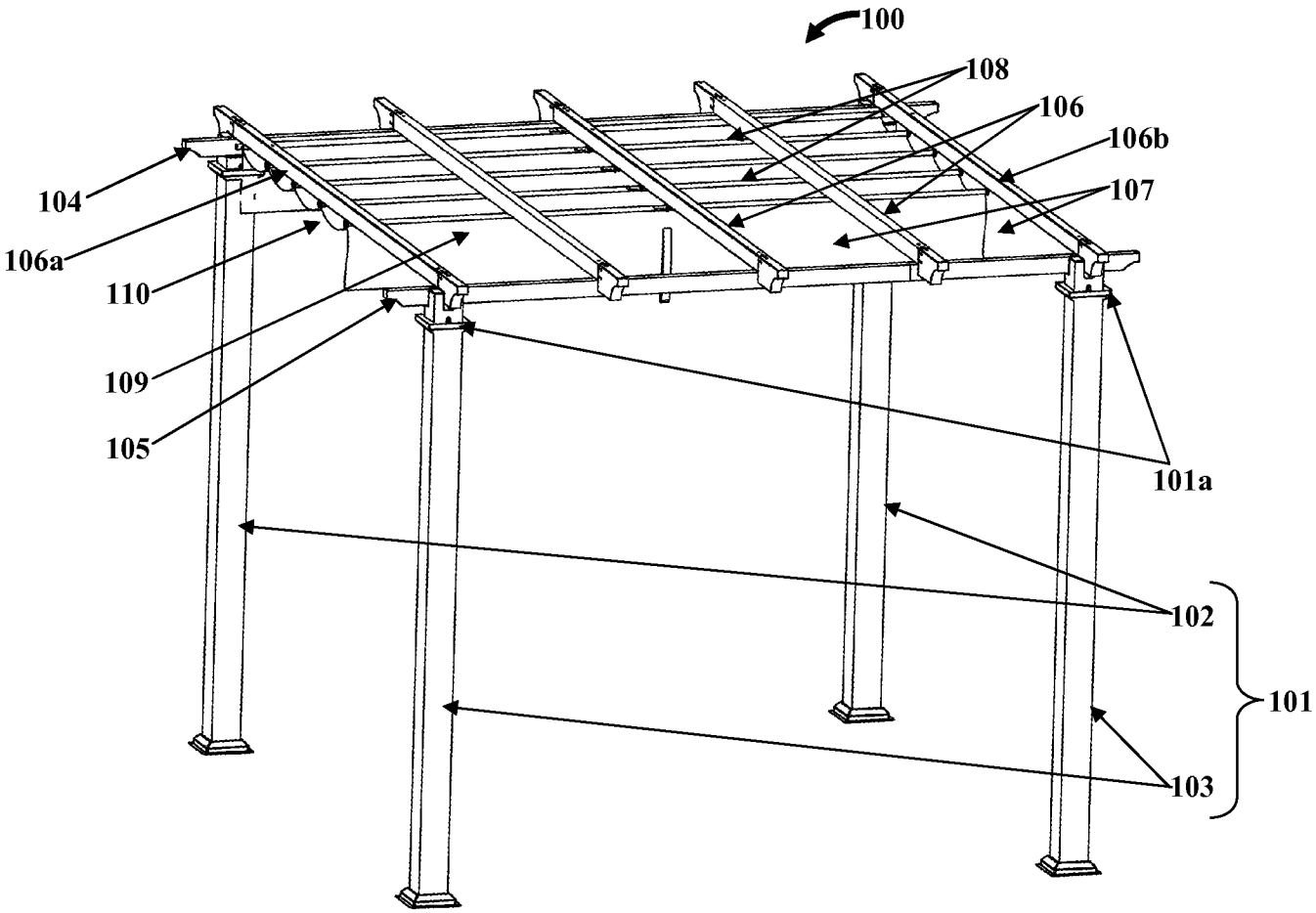
FIG. 1 exemplarily illustrates a front perspective view of a tent apparatus.

FIG. 1 exemplarily illustrates a front perspective view of a tent apparatus 100. The tent apparatus 100 disclosed herein comprises foot pipes 101, at least two beam members 104 and 105, multiple girders 106, pulleys 112 exemplarily illustrated in FIG. 2 and FIG. 3A, multiple cloth tubes 108, and a canopy 109. A first pair 102 of foot pipes 101 is opposably positioned with respect to a second pair 103 of foot pipes 101 in a geometric configuration, for example, a rectangular configuration, a square configuration, etc. A first beam member 104 is positioned perpendicular to the first pair 102 of foot pipes 101 and removably fastened to upper ends 101*a* of the first pair 102 of foot pipes 101. A second beam member 105 is positioned perpendicular to the second pair 103 of foot pipes 101 and removably fastened to upper ends 101*a* of the second pair 103 of foot pipes 101. The girders 106 are positioned perpendicular to the beam members 104 and 105, and removably fastened at predefined intervals 107 to the beam members 104 and 105. The girders 106 comprise internal guide rails 111 exemplarily illustrated in FIG. 2, that allow the pulleys 112 to rollably traverse the internal guide rails 111. In an example, the first beam member 104, the second beam member 105, and the opposing girders 106*a* and 106*b* form a generally square or rectangular ring beam frame. The cloth tubes 108 are, for example, hollow cylindrical tubes configured to carry a cloth element, where the cloth element is wound or slid around a circumferential wall of each cloth tube 108. The cloth tubes 108 are positioned perpendicular to the girders 106 and in sliding communication with the girders 106 via the pulleys 112. Each cloth tube 108 positions a canopy 109 in an accordion configuration 110. As used herein, "accordion configuration" refers to a configuration where the canopy 109 is folded around each cloth tube 108 similar to bellows of an accordion. The canopy 109 is fixedly attached to one of the beam members 104 and 105, for example, the first beam member 104, and in sliding communication with the girders 106. The canopy 109 is stretched across the upper ends 101*a* of the first pair 102 of foot pipes 101 and the second pair 103 of foot pipes 101 when the pulleys 112 are rolled within the internal guide rails 111 of the girders 106.

Figure 2:
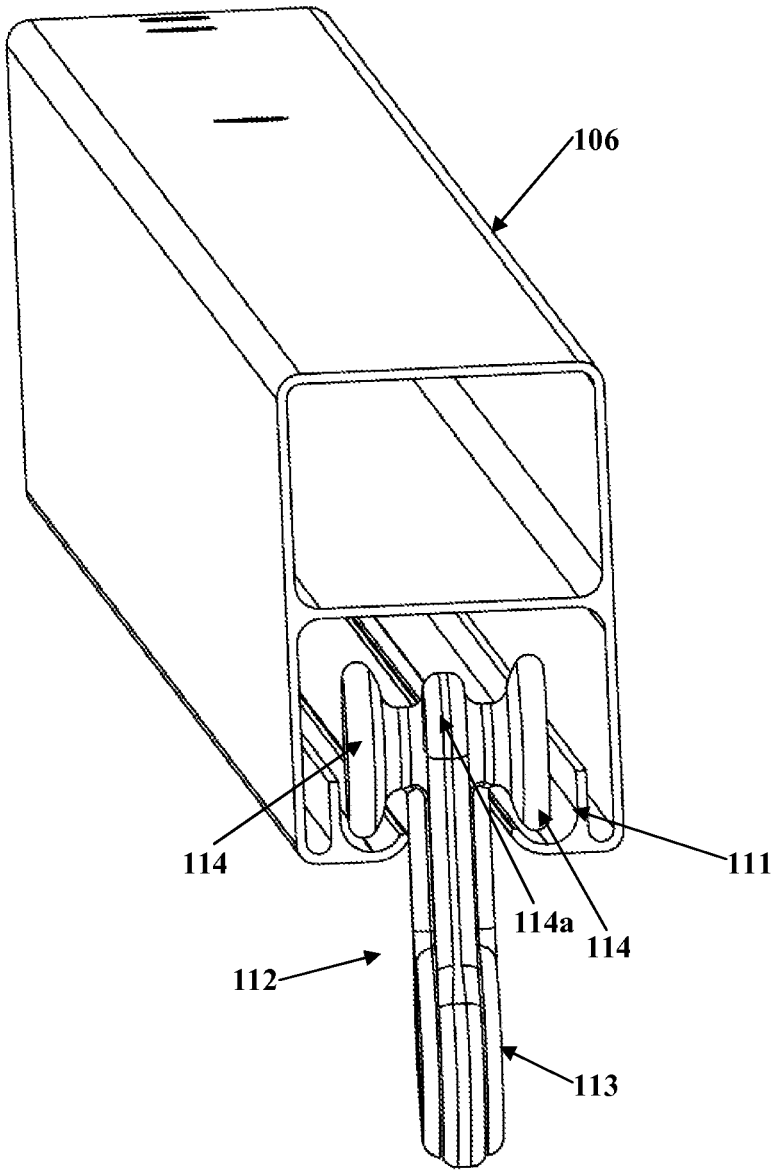
FIG. 2 exemplarily illustrates a front perspective view of a pulley positioned in a girder of the tent apparatus.

FIG. 2 exemplarily illustrates a front perspective view of a pulley 112 positioned in a girder 106 of the tent apparatus 100 exemplarily illustrated in FIG. 1. The girder 106 comprises internal guide rails 111 that allow the pulley 112 to rollably traverse the internal guide rails 111. The pulley 112 exemplarily illustrated in FIG. 2, comprises a handle 113 and wheel members 114, where a top portion 113*a* of the handle 113 is connected to a hub 114*a* of the wheel members 114. The wheel members 114 are in rolling communication with the internal guide rails 111 of the girder 106. The pulley 112 further comprises a receptor member disposed at a bottom portion 113*b* of the handle 113, for example, an opening 122 or a threaded bore hole 123 exemplarily illustrated in FIGS. 3B-3C, to receive and connect one of the cloth tubes 108 exemplarily illustrated in FIG. 1. In an embodiment, each pulley 112 of the tent apparatus 100 is made of a plastic material. For example, the pulley 112 exemplarily illustrated in FIG. 2, is made of plastic wheel members 114 with a plastic handle 113 extending outwardly from the hub 114*a* of the plastic wheel members 114. The pulley 112 is low in mass and cost effective because of the plastic material.

Figure 3A:
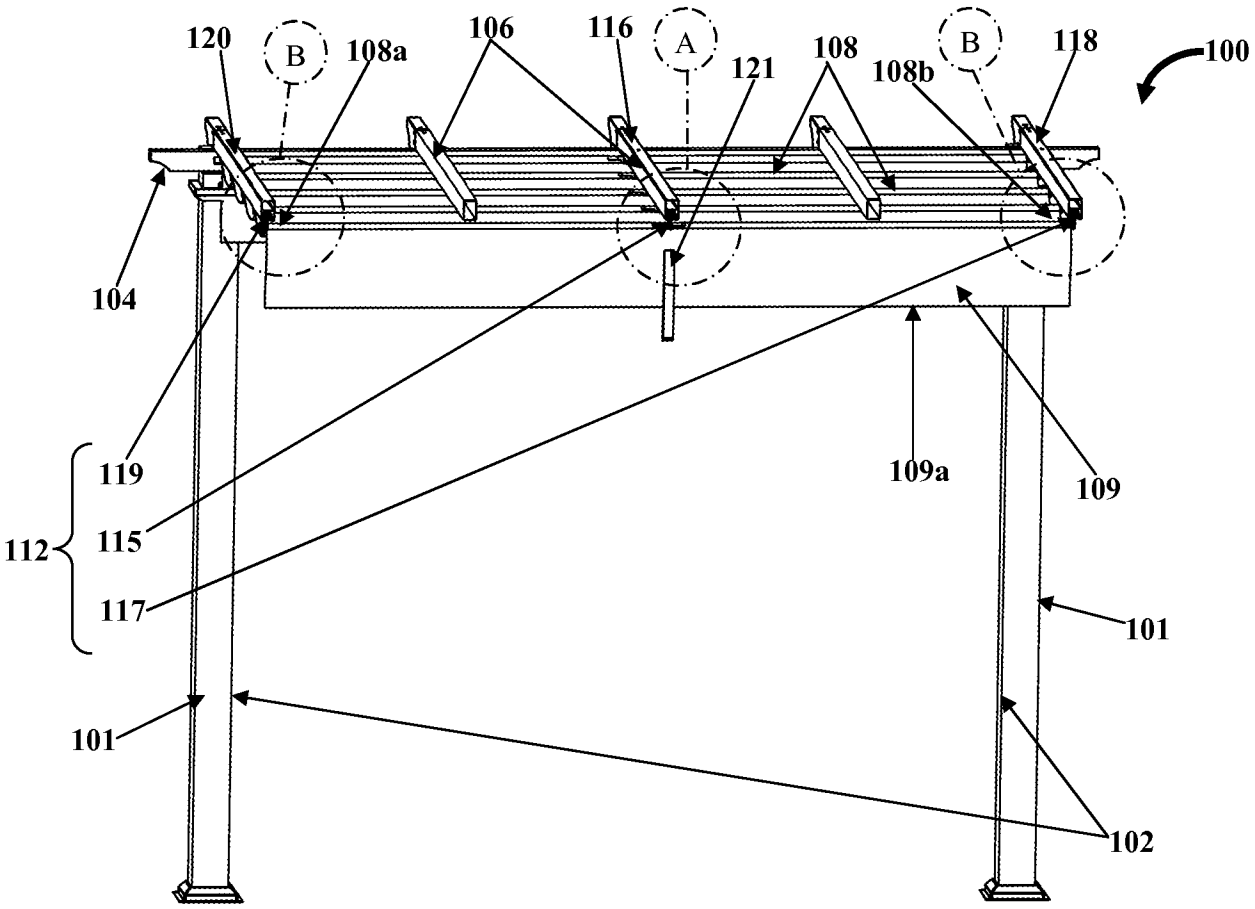
FIG. 3A exemplarily illustrates a partial front perspective of the tent apparatus, showing pulleys in rolling communication with internal guide rails of girders of the tent apparatus.

FIG. 3A exemplarily illustrates a partial front perspective of the tent apparatus 100, showing pulleys 112 in rolling communication with the internal guide rails 111 of the girders 106 exemplarily illustrated in FIG. 2. In an embodiment, the pulleys 112 comprise a central pulley 115, a rightmost pulley 117, and a leftmost pulley 119. The central pulley 115 is in rolling communication with a central girder 116. The rightmost pulley 117 is in rolling communication with a rightmost girder 118. The leftmost pulley 119 is in rolling communication with a leftmost girder 120. The central pulley 115 traverses the internal guide rails 111 of the central girder 116 to stretch the canopy 109 across the upper ends 101*a* of the first pair 102 of foot pipes 101 and the second pair 103 of foot pipes 101 exemplarily illustrated in FIG. 1. The pulleys 112 made of a plastic material are easy to produce on a mass scale, are resistant to breakage failure, have a long service life, and allow a blockage free pulling of the canopy 109. The quality and finish of the pulleys 112 are also easy to control during production. In an embodiment, the tent apparatus 100 disclosed herein further comprises a cloth pulling member 121 fixedly attached proximal to an edge 109*a* of the canopy 109. A user may hold the cloth pulling member 121 to pull and wind the canopy 109 over each of the cloth tubes 108.

Figure 3B:
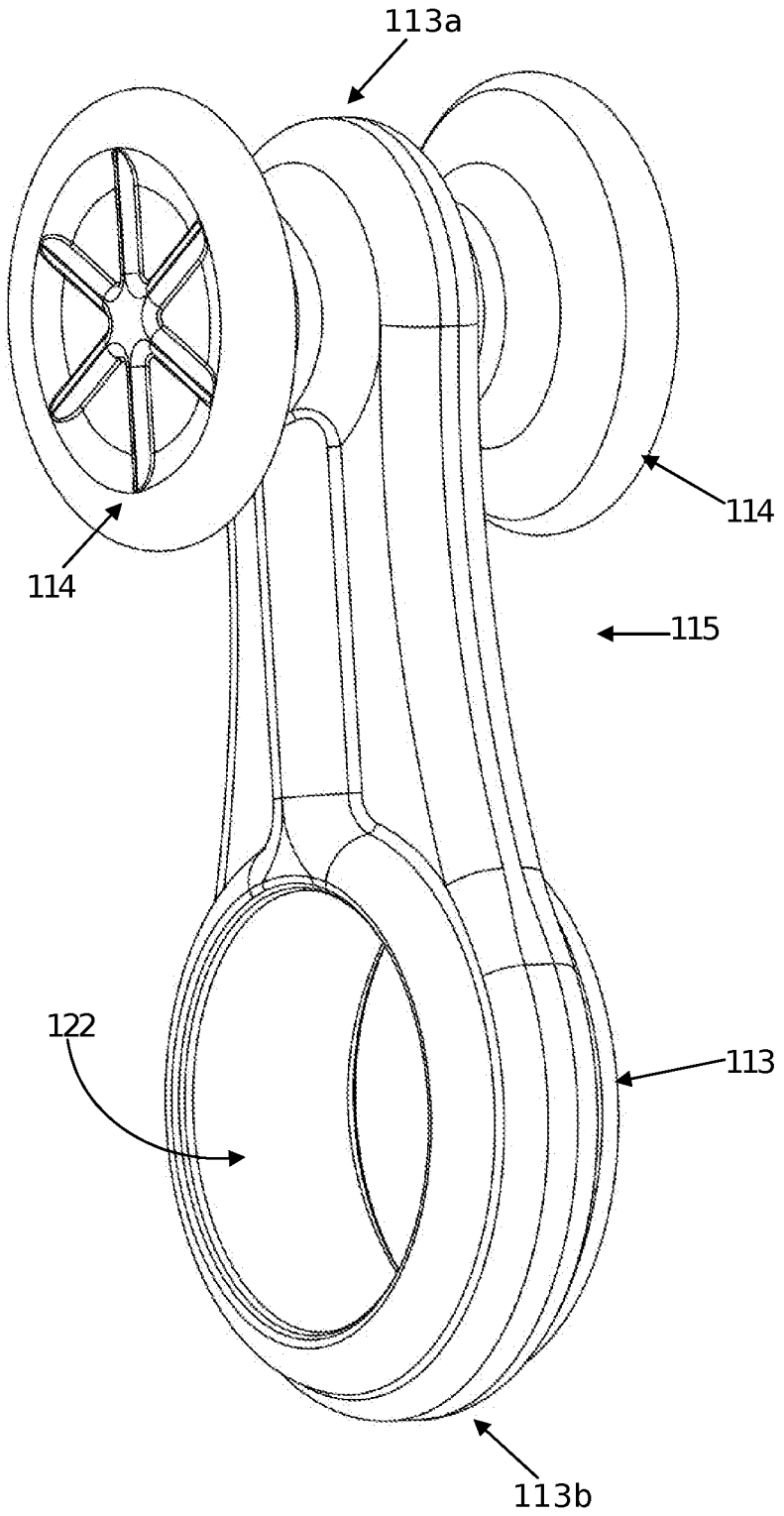
FIG. 3B exemplarily illustrates an enlarged view of a portion marked A in FIG. 3A, showing a front perspective view of a pulley.
Figure 3C:
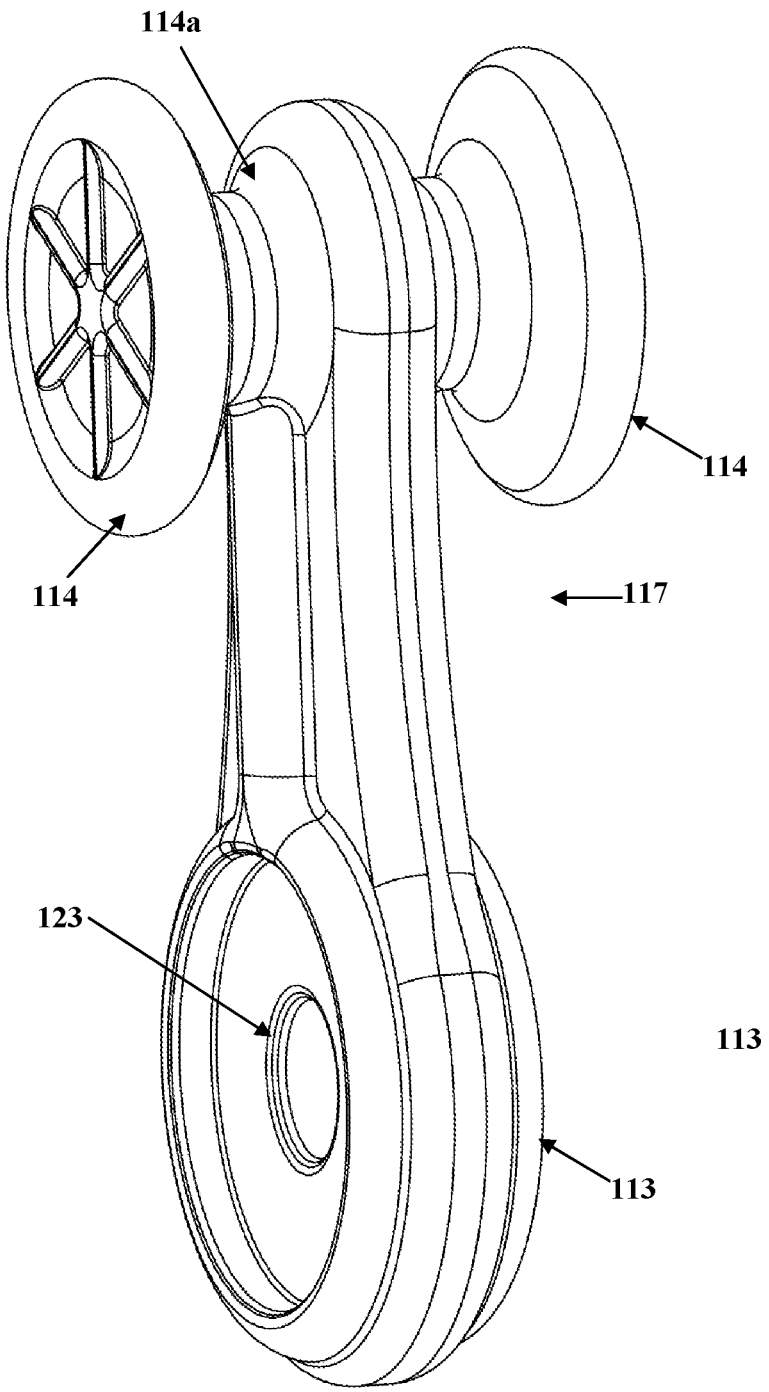
FIG. 3C exemplarily illustrates an enlarged view of a portion marked B in FIG. 3A, showing a front perspective view of an embodiment of the pulley.

FIG. 3B exemplarily illustrates an enlarged view of a portion marked A in FIG. 3A, showing a front perspective view of a pulley 115, and FIG. 3C exemplarily illustrates an enlarged view of a portion marked B in FIG. 3A, showing a front perspective view of an embodiment of the pulley 117. As exemplarily illustrated in FIG. 3B, the receptor member of the central pulley 115 is, for example, an opening 122 for receiving a cloth tube 108 positioned proximal to one of the beam members 104 and 105, for example, the second beam member 105 exemplarily illustrated in FIG. 1. As exemplarily illustrated in FIG. 3C, in an embodiment, the receptor member of the rightmost pulley 117 or the leftmost pulley 119 is, for example, a threaded bore hole 123 configured to fasten opposing ends 108*a* and 108*b* of the cloth tube 108 exemplarily illustrated in FIG. 3A, positioned proximal to one of the beam members 104 and 105, for example, the second beam member 105. In an embodiment, the opposing ends 108*a* and 108*b* of the cloth tube 108 are further fastened to the threaded bore holes 123 of the rightmost pulley 117 and the leftmost pulley 119 via fasteners (not shown), for example, screws and nuts.

In an example, the wheel members 114 of the coaxially arranged central pulley 115, the rightmost pulley 117, and the leftmost pulley 119 are positioned on the internal guide rails 111 of the central girder 116, the rightmost girder 118, and the leftmost girder 120 respectively, exemplarily illustrated in FIG. 2 and FIG. 3A, while one of the cloth tubes 108 positioned proximal to one of the beam members 104 and 105, for example, the second beam member 105, is connected to the threaded bore hole 123 of the rightmost pulley 117, inserted through the opening 122 of the central pulley 115, and then connected to the threaded bore hole 123 of the leftmost pulley 119. The cloth pulling member 121 attached to the edge 109*a* of the canopy 109, for example, the movable side or the free pulley side as exemplarily illustrated in FIG. 3A, is used to pull and wind the canopy 109 across each of the cloth tubes 108. A user can manually pull the central pulley 115 through the internal guide rails 111 of the central girder 116 across the upper ends 101*a* of the first pair 102 of foot pipes 101 and the second pair 103 of foot pipes 101 exemplarily illustrated in FIG. 1, to extend the canopy 109.

Figure 4:
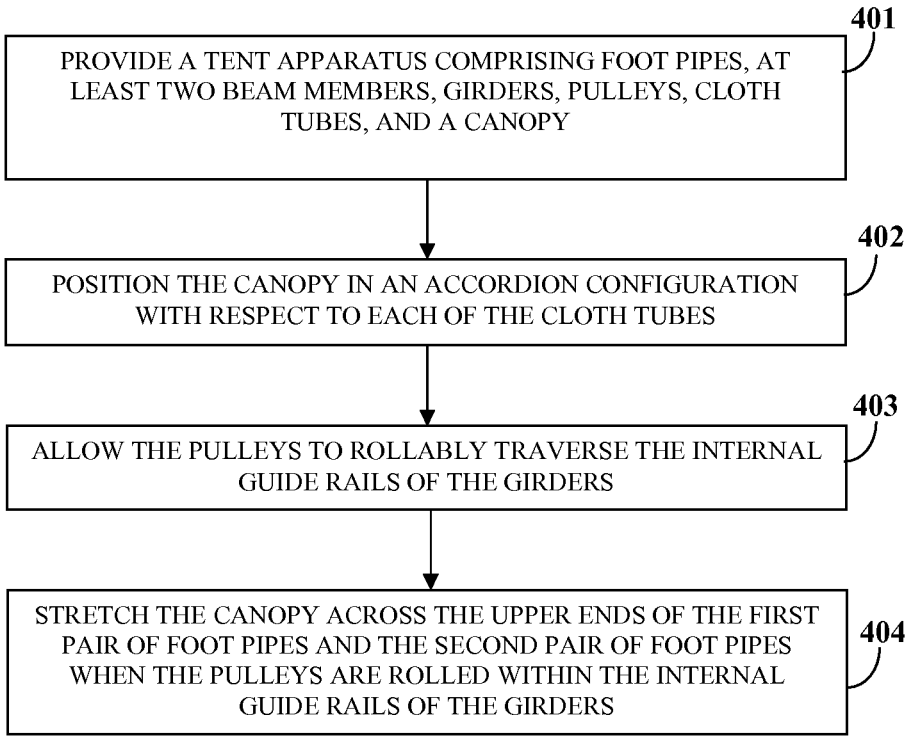
FIG. 4 exemplarily illustrates a method for deploying a canopy.

FIG. 4 exemplarily illustrates a method for deploying a canopy 109 exemplarily illustrated in FIG. 1 and FIG. 3A. The tent apparatus 100 comprising foot pipes 101, at least two beam members 104 and 105, multiple girders 106, multiple pulleys 112, multiple cloth tubes 108, and a canopy 109 as exemplarily illustrated in FIGS. 1-3C and as disclosed in the detailed description of FIGS. 1-3C, is provided 401. The canopy 109 is positioned 402 in an accordion configuration 110 with respect to each of the cloth tubes 108. The pulleys 112 are then allowed 403 to rollably traverse the internal guide rails 111 of the girders 106. When the pulleys 112 are rolled within the internal guide rails 111 of the girders 106, the canopy 109 stretches 404 across the upper ends 101*a* of the first pair 102 of foot pipes 101 and the second pair 103 of foot pipes 101.

The foregoing examples have been provided merely for the purpose of explanation and are in no way to be construed as limiting of the tent apparatus 100 exemplarily illustrated in FIG. 1 disclosed herein. While the tent apparatus 100 has been described with reference to various embodiments, it is understood that the words, which have been used herein, are words of description and illustration, rather than words of limitation. Further, although the tent apparatus 100 has been described herein with reference to particular means, materials, and embodiments, the tent apparatus 100 is not intended to be limited to the particulars disclosed herein; rather, the tent apparatus 100 extends to all functionally equivalent structures, methods and uses, such as are within the scope of the appended claims. Those skilled in the art, having the benefit of the teachings of this specification, may effect numerous modifications thereto and changes may be made without departing from the scope and spirit of the tent apparatus 100 in its aspects.

I claim:

1. A tent apparatus comprising:

foot pipes, a first pair of said foot pipes opposably positioned with respect to a second pair of said foot pipes in a geometric configuration;

at least two beam members, a first of said at least two beam members positioned perpendicular to said first pair of said foot pipes and removably fastened to upper ends of said first pair of said foot pipes, and a second of said at least two beam members positioned perpendicular to said second pair of said foot pipes and removably fastened to upper ends of said second pair of said foot pipes;

a plurality of girders positioned perpendicular to said at least two beam members and removably fastened at predefined intervals to said at least two beam members, each of said girders comprising a pair of internal guide rails on its bottom surface, said pair of internal guide rails extending from one end of each of said girders to other end of each of said girders, each of said girders further comprising a pulley attached to its bottom surface, each of said pulleys configured to rollably traverse from said one end of each of said girders to said other end of each of said girders;

each of said pulleys comprising a handle, a receptor member and a pair of wheel members, one of said pair of wheel members located within and in rolling communication with one of said pair of internal guide rails, another of said pair of wheel members located within and in rolling communication with another of said pair of internal guide rails, said receptor members are one of an opening and a threaded bore hole, said receptor members positioned within a bottom portion of said handle of said each of said pulleys comprises one of a threaded bore hole and an opening, wherein said threaded bore hole and said opening are configured to encircle a circumferential wall of one of a plurality of cloth tubes when said one of said plurality of cloth tubes is inserted inside said threaded bore hole and said opening;

each of said cloth tubes positioned within said receptor members of said pulleys that are adjacently located, each of said cloth tubes positioned perpendicular to said girders, each of said cloth tubes configured to move from said one end of said girders to said other end of said girders when said adjacently located pulleys rollably traverse within said internal guide rails from said one end of said girders to said other end of said girders, each of said cloth tubes configured to position a canopy in an accordion configuration; and said canopy folded around said cloth tubes, said canopy fixedly attached to one of said at least two beam members and in sliding communication with said girders, said canopy configured to be stretched across said upper ends of said first pair of said foot pipes and said second pair of said foot pipes when said cloth tubes move from said one end of said girders to said other end of said girders.

2. The tent apparatus of claim 1, wherein said adjacently located pulleys comprise:

a rightmost pulley in rolling communication with a rightmost of said girders, said rightmost pulley configured to rollably traverse within said pair of internal guide rails from one end of said rightmost girder to other end of said rightmost girder;

a leftmost pulley in rolling communication with a leftmost of said girders, said leftmost pulley configured to rollably traverse within said pair of internal guide rails from one end of said leftmost girder to other end of said leftmost girder; and one or more central pulleys, said central pulleys in rolling communication with girders positioned in between said rightmost and leftmost girders, a pair of wheel members of each of said central pulleys is configured to traverse a pair of internal guide rails of said in between girders from one end of said in between girders to other end of said in between girders to stretch said canopy across said upper ends of said first pair of said foot pipes and said second pair of said foot pipes.

3. The tent apparatus of claim 2, wherein a receptor member of said one or more central pulleys is of said opening type configured to receive a cloth tube, wherein each cloth tube extends from said leftmost girder to said rightmost girder.

4. The tent apparatus of claim 2, wherein a receptor member of each of said rightmost pulley and said leftmost pulley is of threaded bore hole type and is configured to fasten opposing ends of said cloth tube.

5. The tent apparatus of claim 1, further comprising a cloth pulling member fixedly attached proximal to an edge of said canopy, wherein said cloth pulling member is configured to open and close said canopy.

6. The tent apparatus of claim 1, wherein said pulleys are made of a plastic material.

7. A method for deploying a canopy, said method comprising:

providing a tent apparatus comprising:

foot pipes, a first pair of said foot pipes opposably positioned with respect to a second pair of said foot pipes in a geometric configuration;

at least two beam members, a first of said at least two beam members positioned perpendicular to said first pair of said foot pipes and removably fastened to upper ends of said first pair of said foot pipes, and a second of said at least two beam members positioned perpendicular to said second pair of said foot pipes and removably fastened to upper ends of said second pair of said foot pipes;

a plurality of girders positioned perpendicular to said at least two beam members and removably fastened at predefined intervals to said at least two beam members, each of said girders comprising a pair of internal guide rails on its bottom surface, said pair of internal guide rails extending from one end of each of said girders to other end of each of said girders, each of said girders further comprising a pulley attached to its bottom surface, each of said pulleys configured to rollably traverse within said pair of internal guide rails from said one end of each of said girders to said other end of each of said girders;

each of said pulleys comprising a handle, a receptor member and a pair of wheel members, one of said pair of wheel members located within and in rolling communication with one of said pair of internal guide rails, another of said pair of wheel members located within and in rolling communication with another of said pair of internal guide rails, said receptor members positioned within a bottom portion of said handle of said each of said pulleys comprises one of a threaded bore hole and an opening, wherein said threaded bore hole and said opening are configured to encircle a circumferential wall of one of a plurality of cloth tubes when said one of said plurality of cloth tubes is inserted inside said threaded bore hole and said opening;

each of said cloth tubes positioned within said receptor members of said pulleys that are adjacently located, each of said cloth tubes positioned perpendicular to said girders, each of said cloth tubes in sliding communication with said girders via said pulleys, each of said cloth tubes configured to move from said one end of said girders to said other end of said girders when said adjacently located pulleys rollably traverse within said internal guide rails from said one end of each of said girders to said other end of each of said girders; and said canopy folded around said cloth tubes, said canopy fixedly attached to one of said at least two beam members;

positioning said canopy in an accordion configuration with respect to each of said cloth tubes;

allowing said pairs of wheel members of said pulleys to rollably traverse said pairs of internal guide rails of said girders from said one end of each of said girders to said other end of each of said girders; and stretching said canopy across said upper ends of said first pair of said foot pipes and said second pair of said foot pipes by moving said cloth tubes from said one end of said girders to said other end of said girders.

* * * * *